US006095869A

United States Patent [19]

Wang

[11] Patent Number: 6,095,869

[45] **Date of Patent: *Aug. 1, 2000**

[54] ELECTRIC CONNECTOR BODY

[76] Inventor: Tsan-Chi Wang, 4th Floor, No. 8, Lane Ssu-Wei, Cheng Rd., Hsin-Tien City, Taipei Hsien, Taiwan

[ * ] Notice: This patent is subject to a terminal disclaimer.

[21] Appl. No.: 09/121,889

[22] Filed: Jul. 24, 1998

[30] Foreign Application Priority Data

Mar. 25, 1998 [TW] Taiwan ..... 87204410

[51] Int. Cl.[7] ..... H01R 24/00

[52] U.S. Cl. ..... 439/676; 439/490

[58] Field of Search ..... 439/676, 344, 439/660, 490

[56] References Cited

U.S. PATENT DOCUMENTS

| | | | |
|---|---|---|---|
| 4,641,901 | 2/1987 | Brennan et al. | 439/344 |
| 5,704,802 | 1/1998 | Loudermilk | 439/490 |
| 5,957,730 | 9/1999 | Wang | 439/676 |

*Primary Examiner*—Renee Luebke
*Assistant Examiner*—Michael C. Zarroli
*Attorney, Agent, or Firm*—Pollock, Vande Sande & Amernick

[57] ABSTRACT

A conductor rack which is used for an electric connector includes a substantially boxed C-shaped rack body having a top wall, a bottom wall, and a side wall connected between a rear end of the top wall and a rear end of the bottom wall at one end, the bottom wall having a plurality of wire holes at a front end thereof, and a plurality of conductors respectively inserted through the wire holes on the bottom wall and extended out of the rack body.

4 Claims, 3 Drawing Sheets

ELECTRIC CONNECTOR BODY

BACKGROUND OF THE INVENTION

The present invention relates to a conductor rack which is used for an electric connector, especially for a connector shaped like an RJ11 telephone connector.

Regular RJ45 connectors (commonly used as network connectors, and shaped like RJ11 telephone connectors) and RJ11 telephone connectors are equipped with eight conductors and six conductors respectively. Because the size of connectors is very small, therefore it is difficult to make the plastic shell and the conductors integral with each other, so that the machines used for manufacturing these connectors are very expensive. In order to minimize the manufacturing cost of these connectors, the conductor rack and the plastic shell are separately made, and then assembled together. For examples, U.S. Pat. Nos. 4,703,991 and 5,639,267 disclose such structure. However, the arrangement of both conductor racks require long conductors. Therefore, it is necessary to shorten the length of conductors to reduce the cost. Furthermore, the conductor rack according to these connectors is not applicable for holding indicator means. Therefore, these patented techniques cannot be employed for RJ45 or RJ11 connectors with indicator means.

SUMMARY OF THE INVENTION

The present invention has been accomplished under the circumstances in view. It is one object of the present invention to provide a conductor rack which is applicable for use in an electric connector having a RJ45 or RJ11 connector. It is another object of the present invention to provide a conductor rack for an electric connector which greatly shortens the length of the conductors so that the manufacturing cost of the electric connector is reduced. It is still another object of the present invention to provide a conductor rack which is equipped with indicator lights.

According to one aspect of the present invention, the conductor rack of electric connector is substantially boxed C-shaped rack body having a top wall, a bottom wall, and a side wall connected between a rear end of the top wall and a rear end of the bottom wall at one end, the bottom wall having a plurality of wire holes at a front end thereof. A plurality of conductors are respectively inserted through the wire holes on the bottom wall and extended out of the rack body. According to another aspect of the present invention, one or a plurality of indicator lights are provided at the front end of the top wall of the rack body, and a plurality of insertion holes are provided at the rear end of the top wall of the rack body and pierced through the side wall for guiding the lead wires of the indicator lights out of the rack body.

DETAILED DESCRIPTION OF THE PREFERRED EMBODIMENT

Figure 1:
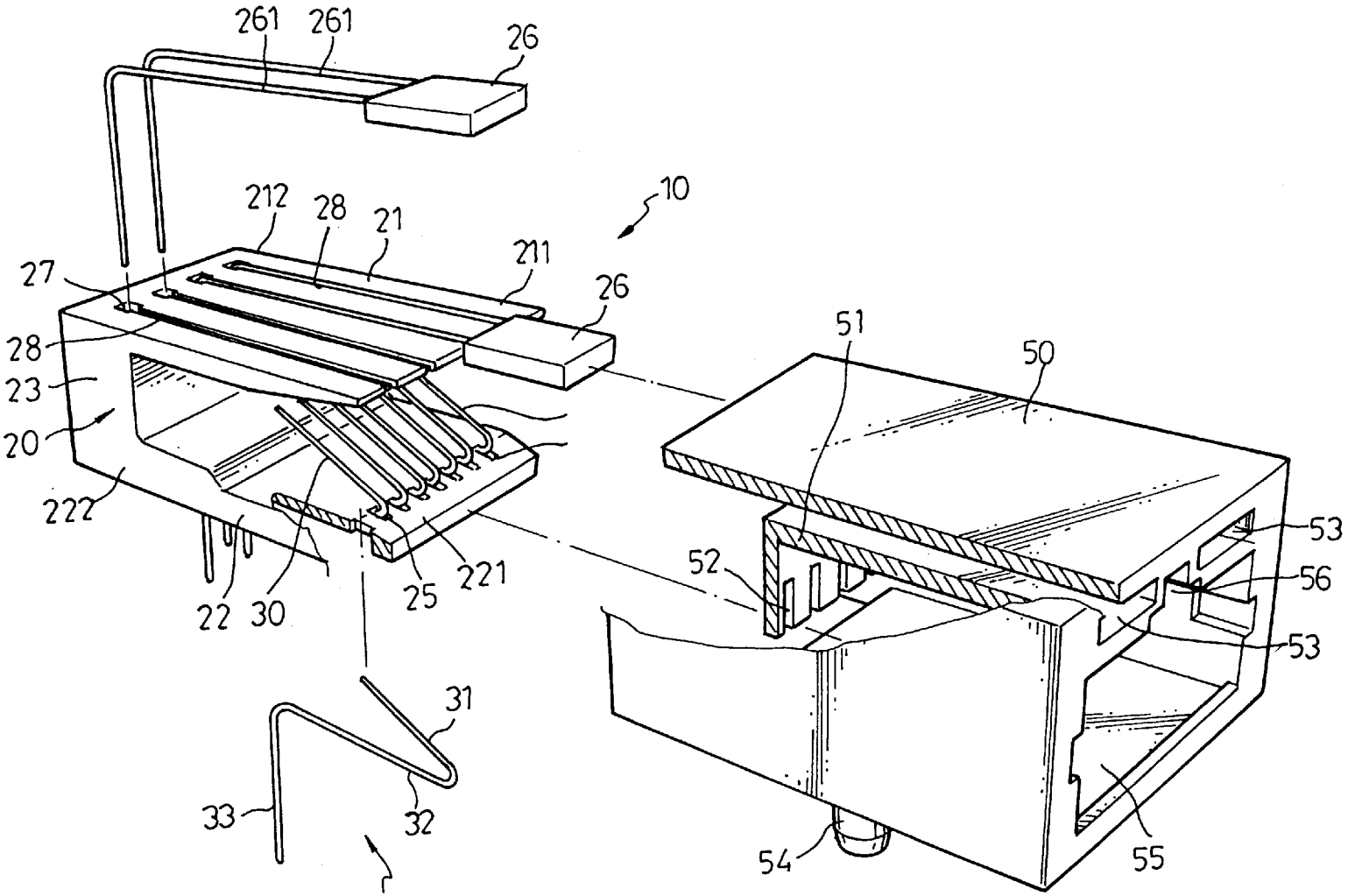
FIG. 1 is a perspective exploded view of a conductor rack according to a first embodiment of the present invention.
Figure 2:
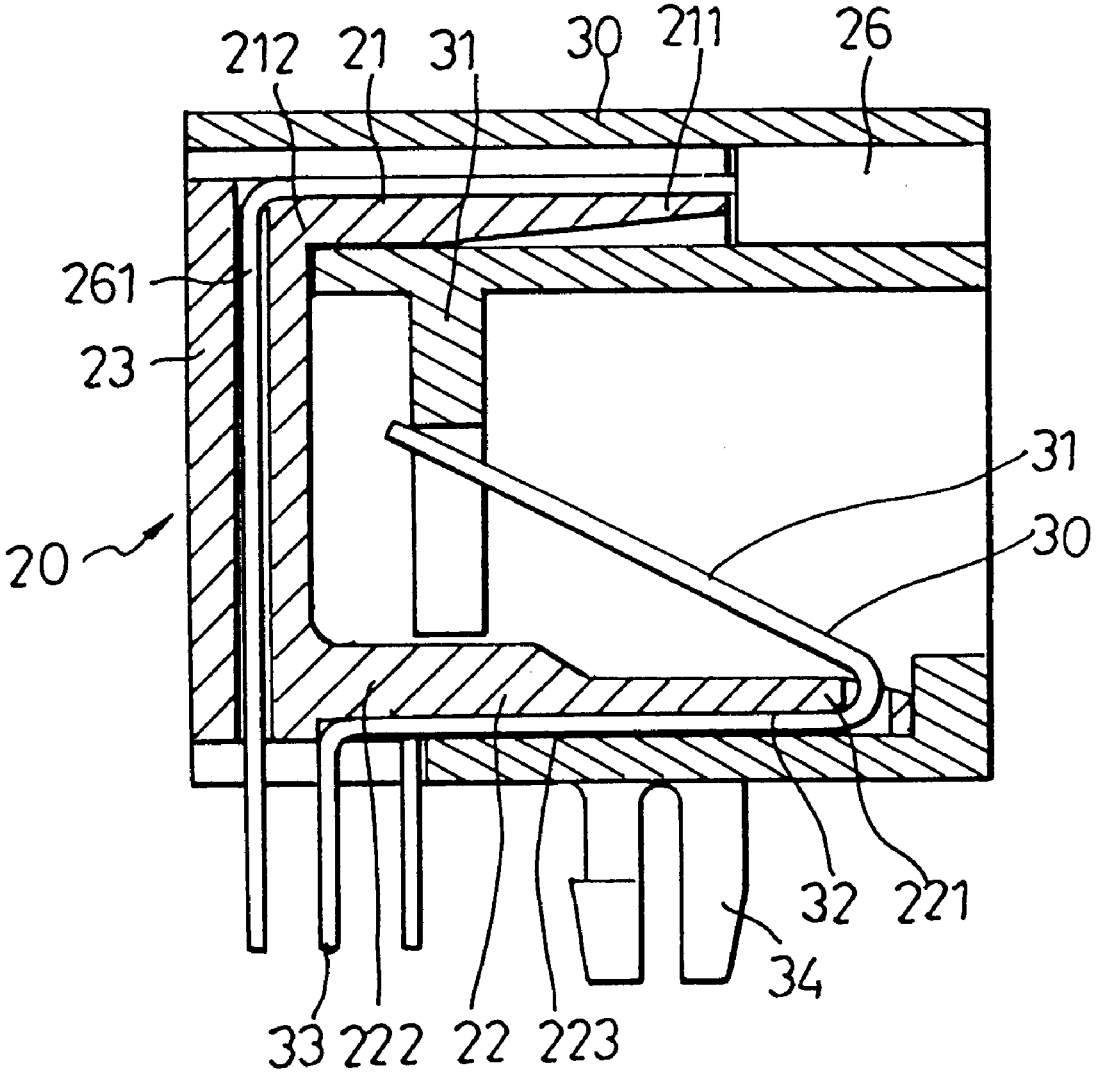
FIG. 2 is a sectional assembly view of the first embodiment of the present invention.
Figure 3:
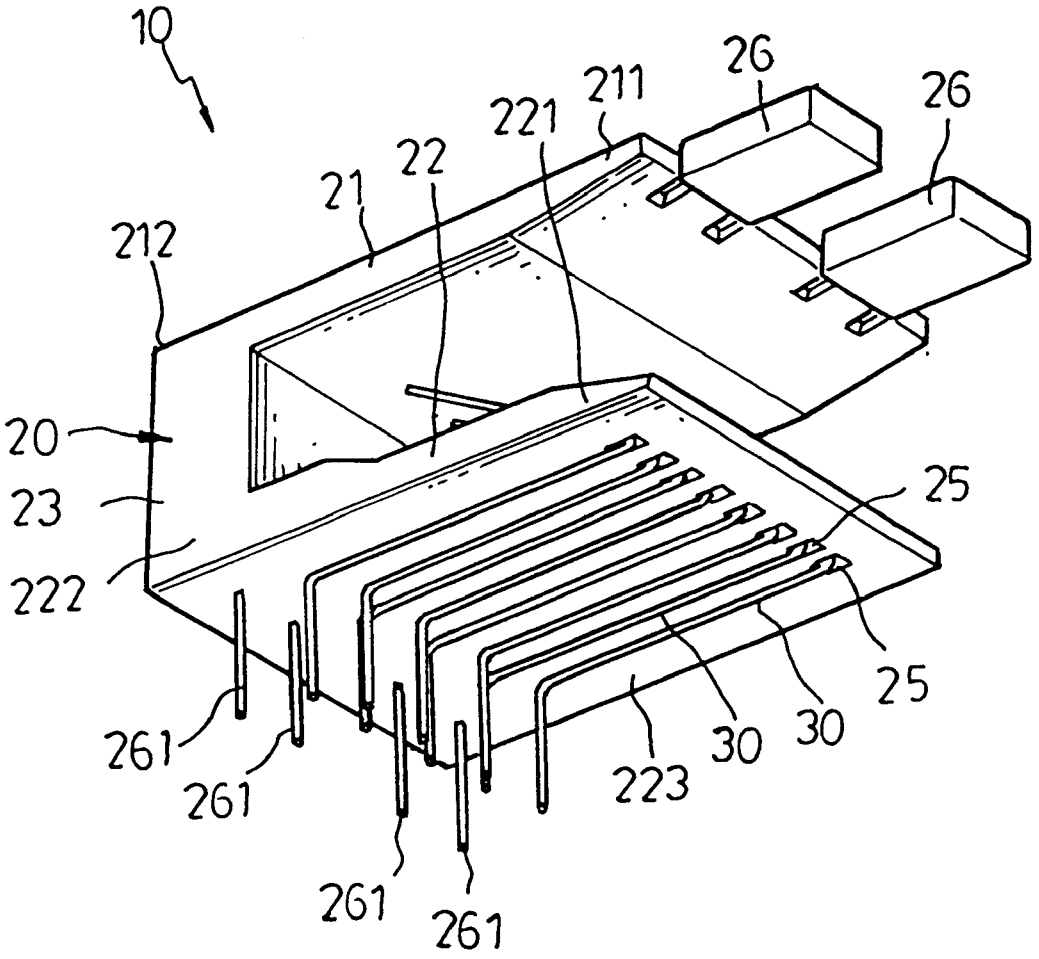
FIG. 3 is a perspective assembly view of the first embodiment of the present invention.

Referring to FIGS. from 1 to 3, the conductor rack 10 which is used for an electric connector in accordance with an embodiment of the present invention, is comprised of a substantially boxed C-shaped rack body 20, a plurality of conductors 30, and two indicator lights 26.

The boxed C-shaped rack body 20 comprises a top wall 21, a bottom wall 22, and a side wall 23 connected between the rear end 212 of the top wall 21 and the rear end 222 of the bottom wall 22. The top wall 21, the bottom wall 22 and the side wall 23 are preferably made integrally with each other. A plurality of wire holes 25 are provided at the front end 221 of the bottom wall 22. The wire holes 25 have, for example, an oblong shape. Alternatively, the wire holes 25 can have circular shape. Four insertion holes 27 are provided at the rear end 212 of the top wall 21. The insertion holes 27 pierce through the side wall 23.

According to the present preferred embodiment, the number of the conductors 30 is eight. This design enables the conductor rack 10 to fit a RJ45 connector (which is used as a network connector having a profile shaped like a telephone connector RJ11). In order to match with the conductors 30, the number of the wire holes 25 is eight. The conductors 30 are respectively inserted through the wire holes 25, and extended outside the rack body 20. Each conductor 30 comprises a sloping section 31 at one end, a vertical section 33 at an opposite end, and a horizontal section 32 connected between the sloping section 31 and the vertical section 33. The sloping section 31 is suspended inside the rack body 20 between the top wall 21 and the bottom wall 22. The connecting area between the sloping section 31 and the horizontal section 32 is inserted through the respective wire hole 25, enabling the horizontal section 32 to be extended toward the rear end 222 of the bottom wall 22 along the outer wall surface 223 of the bottom wall 22, so that the vertical section 33 can be directly soldered to the circuit board.

According to the present preferred embodiment, the number of the indicator lights 26 is two. The indicator lights 26 are mounted on the front end 211 of the top wall 21. The indicator lights 26 are preferably made from LED (light emitting diode) for the advantage of low power consumption. The positive and negative lead wires 261 of the indicator lights 26 are arranged in respective wire grooves 28 on the top wall 21 between the front end 211 and rear end 212 of the top wall 21, and then extended out of the rack body 20 through the insertion holes 27 for connection to the circuit board by soldering.

To form an electric connector, the conductor rack 10 is inserted into a connector shell 50. The shell 50 fits a RJ45 connector, having a plug hole 55 and a retaining hole 56 at the front side for receiving a RJ45 male connector, and a mounting rod 54 at the bottom side for mounting in a locating hole on the circuit board (the mounting rod 54 may be eliminated). A conductor guide board 51 is provided inside the shell 50. The conductor guide board 51 comprises a plurality of slots 52, which receives the sloping sections 31 of the conductors 30. The shell 50 further comprises two light holes 53, which receives the indicator lights 26.

It is to be understood that the drawings are designed for purposes of illustration only, and are not intended as a definition of the limits and scope of the invention disclosed.

What the invention claimed is:

1. A conductor rack suitable an electric connector is a substantially boxed C-shaped rack body, said rack body comprising a top wall having a front end and a rear end, a bottom wall having a front end and a rear end, said bottom wall having a plurality of wire holes at its front end, said wire holes pierced through said bottom wall, a side wall connected between the rear end of said top wall and the rear end of said bottom wall, and a plurality of conductors respectively inserted through the wire holes on the bottom wall of said rack body and extended out of said rack body, wherein said conductors each comprise a sloping section at one end, a vertical section at an opposite end, and a horizontal section in between said sloping section and said vertical section, said sloping section being suspended inside said rack body between said top wall and said bottom wall, a connecting area between said sloping section and said horizontal section being respectively inserted through the wire holes on said bottom wall, enabling said horizontal section to be arranged along an outside wall surface of said bottom wall toward the rear end of said bottom wall.

2. The conductor rack which is used for an electric connector of claim 1 further comprising at least one indicator light mounted on the front end of said top wall of said rack body, and a plurality of insertion holes at the rear end of said top wall which receives lead wires of said at least one indicator light, said insertion holes pierced through the side wall of said rack body to guide lead wires of at least one said indicator light out of said rack body.

3. The conductor rack which is used for an electric connector of claim 1 wherein the number of said conductors is eight.

4. The conductor rack which is used for an electric connector of claim 2 wherein said top wall of said rack body comprises a plurality of wire grooves extended from the front end of said top wall to said insertion holes at the rear end of said top wall for guiding lead wires of said at least one said indicator light.

* * * * *